US008763630B2

(12) United States Patent
Pitt

(10) Patent No.: US 8,763,630 B2
(45) Date of Patent: Jul. 1, 2014

(54) SEWAGE FLUSHING

(76) Inventor: David Pitt, Leigh on Sea (GB)

( * ) Notice: Subject to any disclaimer, the term of this patent is extended or adjusted under 35 U.S.C. 154(b) by 700 days.

(21) Appl. No.: 12/993,891

(22) PCT Filed: May 5, 2009

(86) PCT No.: PCT/GB2009/050463

§ 371 (c)(1),
(2), (4) Date: Feb. 14, 2011

(87) PCT Pub. No.: WO2009/141638

PCT Pub. Date: Nov. 26, 2009

(65) Prior Publication Data

US 2011/0146810 A1 Jun. 23, 2011

(30) Foreign Application Priority Data

May 20, 2008 (GB) ..... 0809150.6

(51) Int. Cl.
*E03F 9/00* (2006.01)

(52) U.S. Cl.
USPC ..... 137/403; 137/454.2; 134/166 C

(58) Field of Classification Search
CPC ..... E03F 9/00; E03F 9/007
USPC ..... 137/396, 403, 454.2; 134/166 C
See application file for complete search history.

(56) References Cited

U.S. PATENT DOCUMENTS

| | | | | |
|---|---|---|---|---|
| 1,753,724 | A * | 4/1930 | Shaw | 137/454.2 |
| 2,577,657 | A * | 12/1951 | Houk | 137/454.2 |
| 4,215,716 | A * | 8/1980 | Klenk et al. | 137/403 |
| 4,321,948 | A * | 3/1982 | Bradley | 137/396 |
| 4,800,907 | A * | 1/1989 | Giehl et al. | 134/166 R |
| 6,640,828 | B2 * | 11/2003 | Dautais | 137/403 |
| 7,584,939 | B2 * | 9/2009 | Stiehl et al. | 137/423 |
| 2006/0081292 | A1 | 4/2006 | Sarno et al. | |
| 2009/0008588 | A1 | 1/2009 | Giehl | |
| 2011/0290343 | A1 * | 12/2011 | Komatsu et al. | 137/386 |

FOREIGN PATENT DOCUMENTS

FR 2878540 A1 * 6/2006

* cited by examiner

*Primary Examiner* — John Rivell
(74) *Attorney, Agent, or Firm* — Renner Kenner Greive Bobak Taylor & Weber

(57) ABSTRACT

A sewer flushing device 20 for location in a sewage system. The device comprises a housing 21 adapted for location in a sewage flow path 14 and a gate 22 pivotally supported on the housing 21 and movable between open and closed positions. The gate is biased towards its closed position so as to inhibit the flow of sewage and thereby cause a build up of sewage. In this way, when the sewage upstream of the gate 22 reaches a predetermined level the gate is urged to its open position such that a flushing pulse of sewage flows downstream.

There may also be provided a locating device 23 for holding the housing 21 in the required position within the sewage system. The locating device may comprise a sewer engaging portion 51,52 adapted to locate in a sewer channel 12,14, and a housing connector 54 adapted to connect to the housing 21.

15 Claims, 3 Drawing Sheets

SEWAGE FLUSHING

The present invention relates to a device for flushing sewage systems so as to prevent the build up of deposits in the interior thereof.

Sewer systems usually comprise a network of connected pipes linking buildings to a sewage treatment facility or waste outlet. The pipes carry human waste such as washing water, faeces, urine, laundry waste and other material which goes down drains such, as runoff rain water, which then needs to be disposed of safely and effectively. In some remote locations sewage is collected in septic tanks or cesspits and may be treated in situ or transported by a vehicle to a sewage treatment facility where it may be disposed of safely, but the pipes of these systems may still requiring cleaning.

In view of the nature of sewage, deposits such as fats, oils and greases accumulate on the interior of the pipes and other conduits in the sewer system, which is particulalry common in systems where the rate of sewage flow is low. Low flow may result from constant dry weather or periods of low waste being produced. The accumulation of such deposits can eventually lead to a complete or partial blockage that inhibits the flow of sewage through the system and ultimately leads to flooding or combined sewer overflow (CSO) discharges. Untreated sewage then becomes entrained in rivers and other watercourses and endangers the lives of life forms living therein and also humans bathing.

In order to minimise the risk of blockages, pipelines should be monitored and high risk areas cleaned periodically. Sewer pipes (also simply referred to as sewers) can be cleaned using pressurised water jetting systems, but these are known to damage the pipes and also pollute ambient air. Such procedures can also be costly.

It is an object of the present invention to provide a cleaning system which is self-sufficient and is operable without human intervention. It is a further object of the invention not to require inspection chamber covers to be opened during operation so as to avoid polluting the surrounding air. Moreover, it is an object of the invention not to damage the sewer system during operation and not to waste more water in the cleansing process which usually becomes entrained in the sewage and require treatment.

According to the present invention, there is provided a sewer flushing device for location in a sewage system, the device comprising a housing adapted for location in a sewage flow path; and a gate pivotally supported on the housing and adapted for movement between open and closed positions, the gate being biased towards its closed position so as to inhibit the flow of sewage and thereby cause a build up of sewage, and when the sewage upstream of the gate reaches a predetermined level the gate is urged to its open position such that a flushing pulse of sewage flows downstream.

Preferably the housing comprises a frame and the gate is correspondingly sized and shaped to fit therein. Sewage systems comprise a network of conduits of various sizes and shapes according to their particular purpose and the usual and peak volume of sewage to flow therethrough. Thus, the size and shape of the frame may be selected to form an appropriate fit within the particular part of the sewage system in which it is to be located.

The gate may be mounted in the housing and arranged to pivot about a generally horizontal axis. This allows the gate to make full use of gravitational forces acting thereon, when moving between closed and open positions. Most preferably the generally horizontal axis is located approximately one third of the way up the gate from the bottom thereof.

Preferably deflectors may be provided on the gate and or the housing to deflect solid debris in the sewage away from the points where the gate is pivotally connected to the housing. Such deflectors may be mounted on the upstream side of the gate and the housing and have a generally tapered triangular profile with the narrow part upstream. Such deflectors aim to prevent solid matter from fouling the movement of the gate.

Many suitable arrangements are known for pivotally supporting gates and they may be suitable for the present invention, but in view of the adverse conditions in the sewage system it is preferable to include as few moving parts as possible. For instance, lugs extending generally horizontally from one of the gate and housing may be arranged to locate in openings provided on the other of the gate and housing. Most preferably such lugs are provided on the gate and the openings are provided on the housing.

The openings for receiving such lugs may comprise keyway slots formed in sidewalls of the housing. These are usually located so that the pivoting axis of the gate is generally horizontal. The keyway slots enable the gate to be securely supported on the housing, while permitting easy attachment and removal of the gate form the housing. In some circumstances, particularly during periods of heavy flow where no intermittent flushing is required or cold weather where there is a risk of the gate freezing onto the housing it may be preferable to temporarily remove the gate. Furthermore, many housings may be located at different points in the sewage system and one or more gate could be periodically moved from one housing to another to vary the position of flushing in the system. The keyway slots may take various forms; some may include several sections angled relative to each other while others may be generally linear. Some of the linear slots may be relatively short with an enlarged head while others may be relatively long with a uniform width. Many arrangements are possible so long as they allow the gate to be removed from the housing without requiring additional parts.

Seals may be provided on the housing. Against these the gate may bear when in its closed position so as to prevent or reduce sewage passing around the gate when in its closed position. The seals may also act as an abutment to limit the angular rotation of the gate when in its closed position. Furthermore, a specific abutment may be provided on the housing to support the gate in its open position and limit the angular rotation. Such an abutment may take a variety of forms, including, for example a bar extending between the sidewalls of the housing. Most preferably the abutment may be sufficiently narrow to avoid obstructing the flow of sewage.

Furthermore, seals may be provided on the gate so as to bear against the housing to inhibit the flow of sewage between the gate and the housing. In one arrangement, a seal is provided around a lower part of the gate so as to bear against the housing and seals are also provided on the housing and arranged to bear against upper parts of the gate. Preferably, elongate seals are provided on opposed sides of the housing and arranged to overlie part of the upstream face of the gate when in its closed position. The elongate seals may taper inwardly towards the lower part of the housing.

Preferably the housing and gate may each have a lower portion shaped to correspond to the sewage channel into which they are located. For example the sewage channel and the lower portion may both be curved and of a similar size so as to form a snug fit.

Preferably the sewer flushing device may be adapted to be located in an inspection chamber having a sewer inlet and a sewer outlet and a sewage flow channel therebetween. Such inspection chambers may be sufficiently large to enable a workman to access the conduit and which would therefore facilitate easy installation, maintenance and removal of the flushing device. Of course, the flushing device could be located in a sewage pipe when building the pipeline or possibly retrofitted.

Preferably a counterweight may be provided on the gate so as to bias the gate to its closed position. Most preferably the counterweight may have smooth contours so as to minimise turbulence as sewage flows thereby and also to reduce the likelihood of debris getting caught thereon. In one embodiment the counterweight is integral to the gate, but in an alternative embodiment the counterweight may be attached to the gate by suitable fastening means so as to facilitate removal therefrom. In some instances it may be preferable to attach a lighter or heavier counterweight to the gate so as to adjust the pre-determined level of sewage that must accumulate to cause the gate to move to its open position.

There may also be provided a locating device to assist in holding the housing in the required position. Such a device may comprise a sewer engaging portion adapted to locate in the sewer channel, and a housing connector adapted to connect to the housing.

Most preferably the sewer engaging portion is shaped to form a snug fit within a sewage inlet or outlet such as the inlets and outlets of the inspection chamber, thereby providing means by which the locating device and thus the flushing device may be secured in place. Additionally, the locating device may further comprise connecting means for fastening the locating device to parts of the chamber.

The housing connector may comprise at least one rigid protrusion adapted to extend into a lower part of the housing and overlie the base thereof, such that in use the base of the housing is lodged between the bottom of the sewer and the rigid protrusion. Most preferably the rigid protrusion may form a snug fit with the interior of the lower portion of the housing.

The sewage flushing system may also comprise baffles adapted to prevent sewage passing alongside the housing and bypassing the gate when in its closed position. For instance, a baffle may be mounted on opposed sides of the housing and connected to an adjacent wall so as to inhibit the flow of sewage and also serve to secure the flushing device in the required position.

One specific embodiment of the present invention will now be described in detail, with reference being made to the following drawings, in which, FIG. 1 is a perspective view of a flushing device located in sewer below a manhole and having a gate shown in a closed position; and FIG. 2 corresponds to the arrangement shown in FIG. 1, but with the gate shown in an open position.

FIGS. 1 to 5 show one embodiment of the invention which is to be located in a sewer as it passes through an inspection point (also referred to as a manhole) of a sewage system. The manhole comprises a chamber having a downstream wall 11 provided with a circular sewage outlet 12, an upstream wall (not shown) provided with a circular sewage inlet (not shown) and a floor 13 in which there is formed a semicircular channel 14 extending between the sewage inlet and outlet. The channel 14 provides a flow path for sewage between the inlet and outlet.

Figure 1:
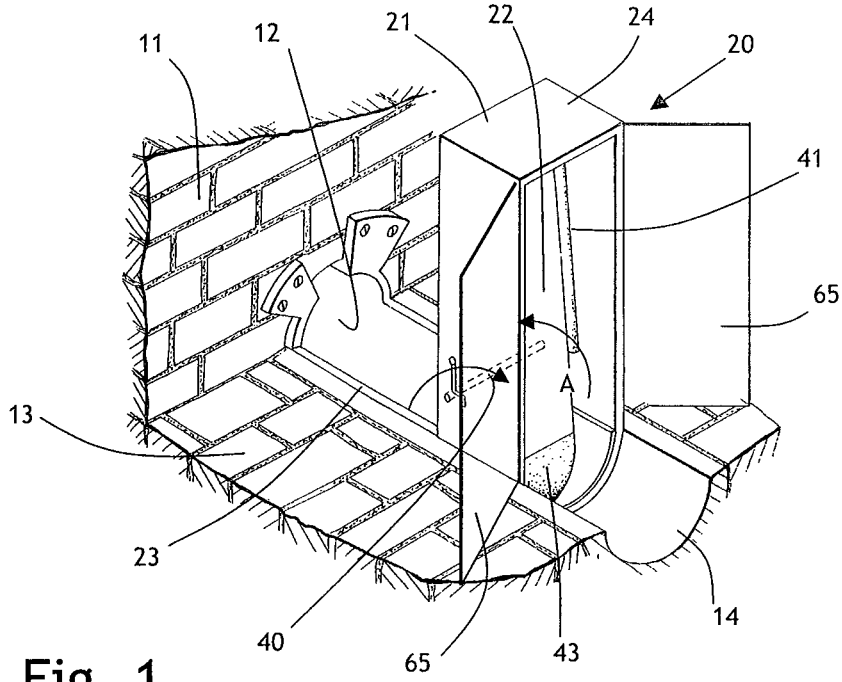
Figure 2:
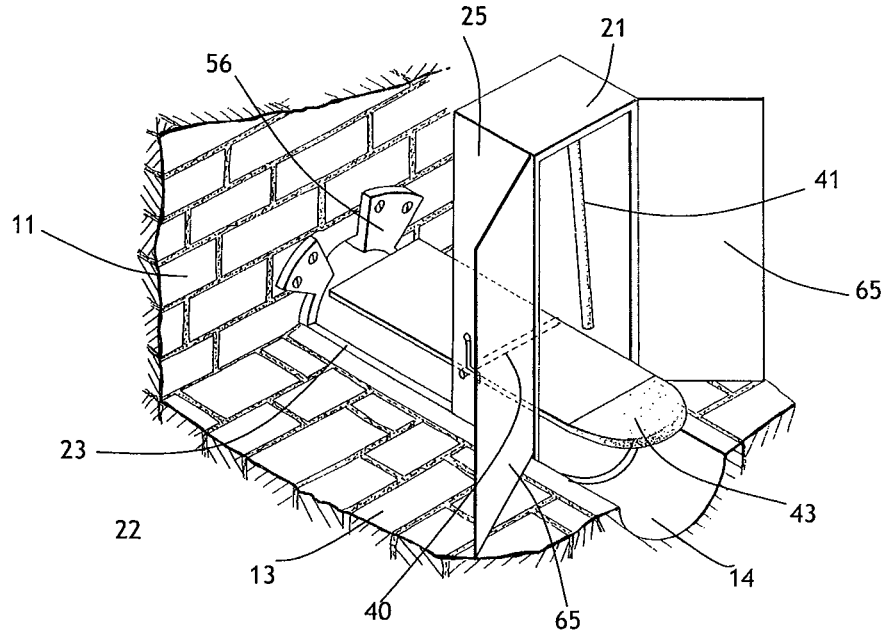
Figures 3, 4:
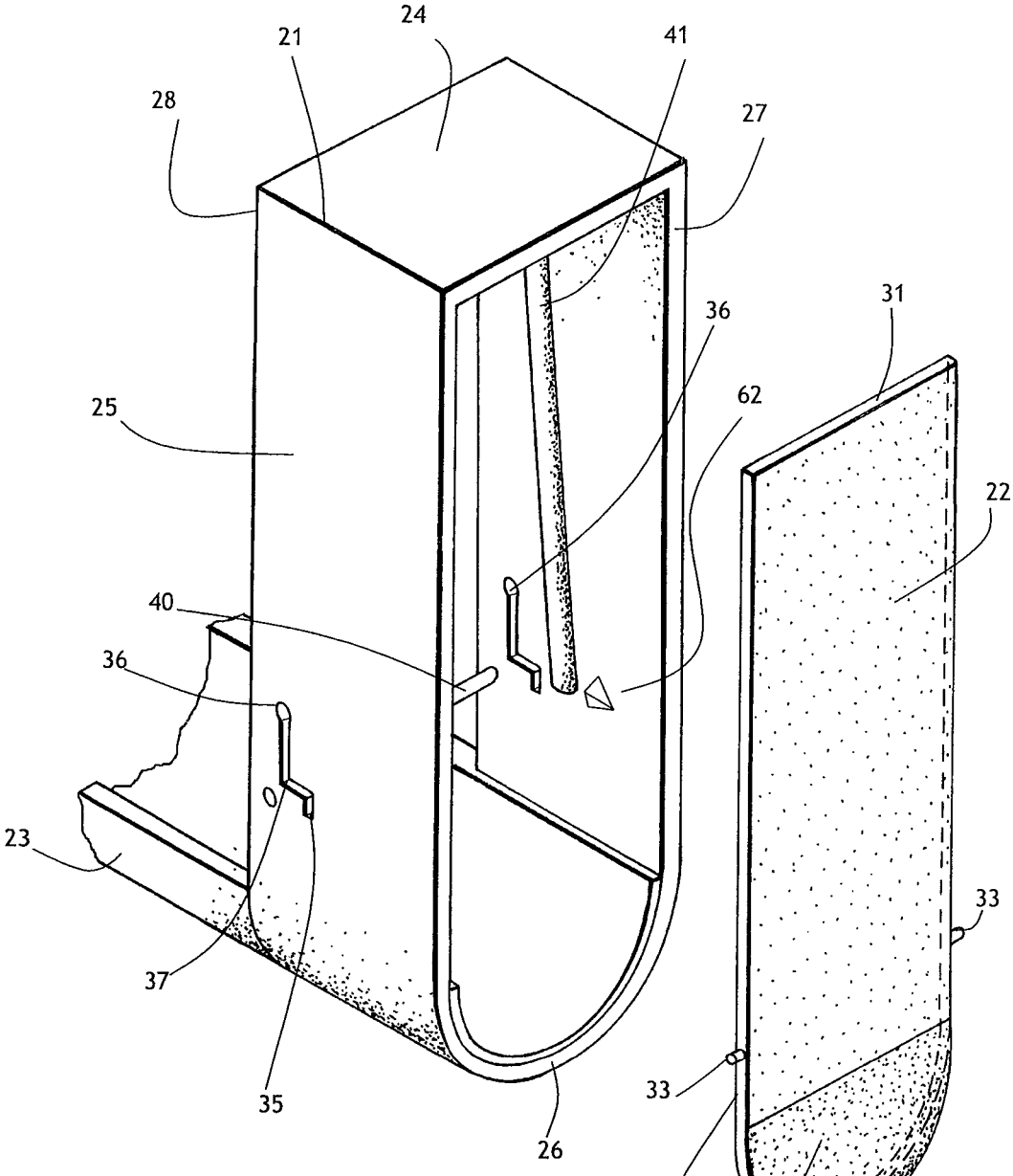
FIG. 3 is a perspective view of a housing forming part of the invention.
FIG. 4 is a perspective view of the gate shown in FIGS. 1 and 2.

Referring specifically to FIGS. 1 and 2, there is shown a flushing device generally indicated 20 and comprising a housing 21, a gate 22 pivotally mounted in the housing and a housing locator 23 for holding the housing in the required position. Referring also to FIG. 3, the housing 21 has a top 24, two sidewalls 25 a base 26, an upstream face 27 and a downstream face 28. In this embodiment of the invention, the base 26 is curved to form a snug fit in the channel 14. The shape of the base 26 can be adapted to suit different shape sewage channels and so need not necessarily be curved. For instance, it could be flat if the housing 21 is to be seated in a sewage channel having a generally rectangular cross-section.

Referring to FIG. 4, the gate 22 is generally planar and has two opposed side edges 30, a top edge 31 and a semicircular bottom 32 so as to correspond closely to the shape and size of the internal profile of the housing 21. Each side edge 30 of the gate 22 is provided with a cylindrical stud 33 extending perpendicular therefrom and equidistantly from the top edge 31 so as to define an axis about which the gate 22 can be pivotally supported.

A keyway slot 35 is formed in each sidewall 25 of the housing 21 and arranged to receive a respective stud 33 extending from an adjacent edge 30 of the gate 21. Each keyway slot 35 comprises a large circular opening 36 and a narrow Z shaped opening 37 extending downwardly from the large opening. The large opening 36 of each keyway slot 35 is necessary to assist mounting the gate 22 in the housing 21, as the distance between the ends of the studs 33 is greater than the internal width of the housing 21. Fitting the gate 22 into the housing 21 requires the gate to be presented at an angle relative to the two sidewalls 25 so that one stud can be inserted into its respective large opening and then the angle of the gate relative to the sidewalls can be adjusted so as to locate the other stud into its respective large opening. The position of the studs 33 relative to the base 32 of the gate 22 must correspond to the position of the keyway slots 35 relative to the base 26 of the housing 21 for an effective seal to be created and the gate to fit sufficiently well in the housing 21. However, the height of the pivoting axis is proportional to the amount of sewage that must accumulate upstream of the flushing device to urge the gate 22 to its open position as shown in FIG. 2. Naturally, a higher pivot axis creates a greater moment and therefore more sewage is required to urge the gate 22 to its open position.

A bar 40 extends between the two sidewalls 25 of the housing 21 at substantially the same height as the pivoting axis of the gate 22, but near the downstream face 28 so as to provide a surface against which the gate 22 bears when in its open position as shown in FIG. 1.

Seals 41 project inwardly from the internal faces of the two sidewalls 25 so as to provide a sealing surface against which the gate bears when in its closed position. Each seal has a lower end located just above the pivoting axis of the gate 22, so as not to obstruct the movement of the gate from its closed position to its open position. Seals could also be provided for the lower portion of the gate but these might inhibit sewage flow, so are usually omitted.

A counterweight 43 is provided on the lower end of the gate 22, which, under the force of gravity biases the gate towards its closed position. The counterweight provided on the gate shown in FIG. 3 is integral to the gate 22 such that the gate and counterweight form a unit made from a single mould. In an alternative arrangement (not shown) the counterweight may be secured to the gate by screws, bolts or like fasteners so as to enable it be substituted by a heavier or lighter counterweight. Along with the vertical position of the pivot axis, the weight of the counterweight is a significant factor in determining when the gate moves to its open position, as a heavier counterweight would require a greater build up of sewage upstream of the flushing device 20 to urge the gate 22 to its open position. Conversely a light counterweight would require a lesser build up of sewage upstream of the flushing device. The counterweight 43 has a curved profile so as to form smooth contours with the gate 22 and not collect refuse and debris or obstruct sewage flowing through the gate housing 21. Bulky counterweights can be used but they are more likely to attract debris and refuse and also obstruct the flow of sewage thereby causing turbulence. Counterweights may be made from heavy materials so as to minimise their size.

Figure 5:
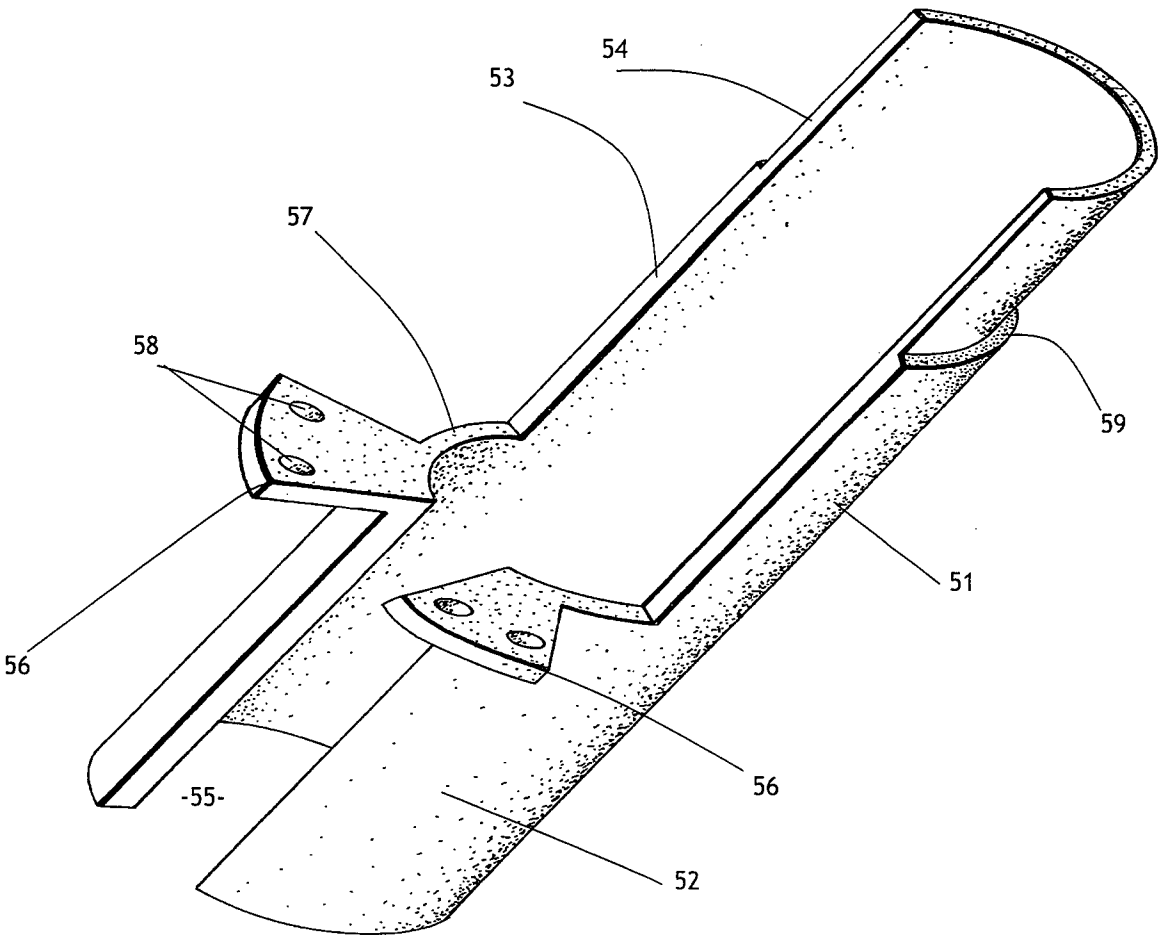
FIG. 5 is a view of a housing locator for securing the flushing device in a sewer.

Referring now to FIG. 5, there is shown in more detail the housing locator 23. This comprises an elongate body 51 having a downstream end 52 adapted to locate in the outlet pipe 12 of the manhole 10, a middle section 53 and an upstream end 54 adapted to locate inside the housing 22. The first end forms a cylindrical tube having a slit 55 extending along its entire length, the cylindrical tube having a diameter suitable to form a snug fit inside the outlet pipe 12. The slit 55 enables the tube to undergo a degree of deformation so as to conform to any irregularities inside the outlet pipe 12. Two generally planar ears 56 extend radially from an end face 57 of the downstream end 52 and these are arranged to bear against the downstream wall 11 of the manhole when the cylindrical tube is located in the outlet pipe 12. A pair of holes 58 formed in each ear 56 enables the first end 52 to be secured to the downstream wall 11, by screws or other suitable fasteners.

The middle section 53 of the housing locator 23 comprises a semicircular channel having an outer radius corresponding in size to the inner radius of the semicircular channel 14, so that the middle section may be located snugly in said channel.

The upstream end 54 is an extension of the middle section 53 in that it is a semicircular channel having an internal radius equal to that of the middle section so that the middle section 53 and second end 54 define a continuous interior. However, the external radius of the second end 54 is slightly smaller than that of the middle section 53, the difference in size being substantially equal to the wall thickness of the gate housing 21 such that an axial shoulder 59 is defined on an axial face of the middle section 53.

Thus, when the housing locator 23 is fitted in the manhole 10 a semi annular space is defined between the exterior of the second end 54 and the semicircular channel 14 in the floor 13. The gate housing 21 can then be positioned in the floor channel 14 behind the locator housing 23 and slid forward so that the base locates in the semi annular space, the rear face 28 of the housing abuts the should 59 and the upstream end 54 forms a liner sleeve over the internal face of the base 26, thereby holding the gate housing 21 firmly in position.

As shown in FIGS. 1 and 2, baffles 65 are mounted on opposed sides of the gate housing 21 and extend to adjacent sidewalls or the upstream wall of the chamber so as to prevent sewage bypassing the housing as it builds up when the gate 22 is closed. Each baffle 65 must be sufficiently well fastened to the chamber walls to withstand the heavy loads applied by the sewage accumulating therebehind. This also aids the fixing of the housing.

In use, the gate 22 is biased to its closed position by the counterweight and sewage flowing down the sewer accumulates behind the gate housing 21 and baffles 65. When the height of accumulated sewage reaches a predetermined level the gate 22 will pivot to its open position (FIG. 2). The predetermined level is reached when the load applied to the gate 21 by the sewage creates a greater moment of force in the direction of arrow A than the moment of force created by the counterweight (and to a degree the sewage) in the direction of arrow B. In some instances a greater volume of sewage is needed to cleanse the system thoroughly and so a heavier counterweight 43 can be attached to the gate 22 to increase the amount of sewage that must accumulate before the gate 22 opens. If the counterweight is too heavy the gate will require an unfeasible amount of sewage to accumulate before it moves to its open position. In fact, the sewage level might rise so much that sewage flows through the space between the gate 22 and the top 24 of the housing 21 and in which case the gate 22 may never open.

In some instances it may be preferably to remove the gate 22 from the gate housing 21 or even remove the gate housing 21, particularly during periods of high sewage flow where there is a concern that the accumulation may cause flooding. Alternatively, flushing devices may be installed at various locations in the sewage system, but only some of those devices may be provided with gates so as to vary the level of cleansing at different locations in the system. To this end, the keyway slots 35 facilitate easy removal of the gate 22 from the gate housing 21 and the locator housing 23 facilitates easy removal of the gate housing 21 from the manhole 10.

FIG. 3 also shows a deflector 62, and an equivalent one (not visible) is provided on the opposite side. These are arranged to deflect sewage (and in particular solid matter entrained therein) away from the lugs 33, so as to prevent debris becoming trapped on or around said lugs as the sewage passes through the housing 21. Each deflector 62 located on an inside face of the housing upstream of the lugs level with the pivoting axis of the gate 22.

The invention claimed is:

1. A sewer flushing device for location in a sewage system, the device comprising a housing adapted for location in a sewage flow path;

a gate pivotally supported on the housing and adapted for movement between open and closed positions, the gate being biased towards its closed position so as to inhibit the flow of sewage and thereby cause a build up of sewage, and when the sewage upstream of the gate reaches a predetermined level the gate is urged to its open position such that a flushing pulse of sewage flows downstream, and a locating device for holding the housing in the required position, the device comprising a sewer engaging portion adapted to locate in the sewer channel and a housing connector connected to the housing and comprising a rigid protrusion that extends into a lower part of the housing, such that in use the base of the housing is lodged between the bottom of the sewer and the rigid protrusion.

2. A sewer flushing device according to claim 1, wherein the housing comprises a frame and the gate is correspondingly sized and shaped to fit therein.

3. A sewer flushing device according to claim 1, wherein the gate is mounted in the housing and arranged to pivot about a generally horizontal axis.

4. A sewer flushing device as claimed in claim 3, wherein the horizontal axis about which the gate pivots is positioned substantially one third of the way up the gate from the bottom thereof.

5. A sewer flushing device according to claim 3, wherein lugs extending generally horizontally from one of the gate and housing are arranged to locate in openings provided on the other of the gate and housing.

6. A sewer flushing device according to claim 3, wherein deflectors are provided on the gate or the housing to deflect sewage away from the horizontal axis.

7. A sewer flushing device according to claim 5, wherein the openings comprise keyway slots formed in sidewalls of the housing so that the pivoting axis of the gate is generally horizontal.

8. A sewer flushing device according to claim 1, wherein seals are provided on the housing and against which the gate bears when in its closed position.

9. A sewer flushing device according to claim 1, wherein an abutment is provided on the housing to support the gate in its open position and limit the angular rotation.

10. A sewer flushing device according to claim 1, wherein the housing and gate each have a lower portion shaped to correspond to the sewage channel against which they bear.

11. A sewer flushing device according to claim 1, which is adapted to be located in an inspection chamber having a sewer inlet and a sewer outlet.

12. A sewer flushing device according to claim 1, wherein a counterweight is provided on the gate so as to bias the gate to its closed position.

13. A sewer flushing device according to claim 1, wherein the sewer engaging portion is shaped to form a snug fit within a sewage inlet or outlet.

14. A sewer flushing device according to claim 1, wherein the locating device further comprises connecting means for fastening the locating device to parts of the chamber.

15. A sewer flushing device as claimed in claim 1 and further comprising at least one baffle adapted to prevent sewage passing alongside the housing and bypassing the gate when in its closed position.

* * * * *